US006026541A

United States Patent [19]

Bailey et al.

[11] Patent Number: 6,026,541

[45] Date of Patent: Feb. 22, 2000

[54] MULTI-PURPOSE ATTACHMENT TOOL FOR A HAND-HELD VACUUM CLEANER

[76] Inventors: Kevin Bailey, 634 Warell Ave., Ottawa, Canada, K2A 3AB; Troy Gene Anderson, 26 Phillips St., Marblehead, Mass. 01945; Ambrose Shing-Yin Leung; Benson Chung-Pun Leung, both of RM1202, 22-28 Tai Chung Road, Tsuen Wan, N.T., China

[21] Appl. No.: 09/164,536

[22] Filed: Sep. 30, 1998

[51] Int. Cl.[7] ..... A47L 9/02

[52] U.S. Cl. ..... 15/414; 15/344

[58] Field of Search ..... 15/344, 414, 415.1

[56] References Cited

U.S. PATENT DOCUMENTS

| | | | |
|---|---|---|---|
| 4,011,624 | 3/1977 | Proett . | |
| 4,209,875 | 7/1980 | Pugh et al. . | |
| 4,225,814 | 9/1980 | Gantz et al. . | |
| 4,841,594 | 6/1989 | Elson et al. . | |
| 4,939,810 | 7/1990 | Ataka | 15/414 X |
| 4,942,641 | 7/1990 | Gerke, Jr. et al. . | |
| 4,951,348 | 8/1990 | Krasznai et al. . | |
| 5,388,303 | 2/1995 | Hemmann et al. . | |
| 5,452,493 | 9/1995 | Galindo | 15/414 |
| 5,462,311 | 10/1995 | Cipolla . | |
| 5,586,360 | 12/1996 | Diederiks et al. | 15/414 X |
| 5,715,569 | 2/1998 | Dickey . | |
| 5,778,939 | 7/1998 | Hok-Yin . | |
| 5,787,546 | 8/1998 | Bass et al. . | |

*Primary Examiner*—Chris K. Moore
*Attorney, Agent, or Firm*—Albert Peter Durigon

[57] ABSTRACT

A multi-purpose attachment tool for a hand-held vacuum cleaner combines the functionality of both a crevice tool and an extension wand in a single instrument. The multi-purpose attachment tool for a hand-held vacuum cleaner includes an insertion end adapted for friction-fit slidable mounting into the nozzle end of the hand-held vacuum cleaner, a nozzle end adapted for cleaning crevices and the like, and a self-supporting accordion-joint interconnecting the two ends. The self-supporting accordion-joint, preferably an annular bellows, is both axially extendable and bendable off-axis. When it is in its axially collapsed condition, the multi-purpose attachment tool serves as a crevice tool, but when it is axially extended, or axially extended and bent off-axis, the multi-purpose attachment tool serves as a crevice tool and/or an extension wand depending on the cleaning application.

10 Claims, 3 Drawing Sheets

MULTI-PURPOSE ATTACHMENT TOOL FOR A HAND-HELD VACUUM CLEANER

FIELD OF THE INVENTION

This invention is drawn to the field of cleaning devices, and more particularly, to a novel multi-purpose attachment tool for a hand-held vacuum cleaner.

BACKGROUND OF THE INVENTION

Hand-held vacuum cleaners of the type having a nozzle end and a handle end are known as exemplified by U.S. Pat. Nos. 4,209,875 and 4,225,814, incorporated herein by reference. When gripped by their handle ends and moved in a generally back and forth oscillatory motion, the nozzle ends of these devices trace a back and forth cleaning path.

The wrist of the hand by which the handle ends are gripped controls the trajectory of their nozzle ends. When in normal use with the hand extended straight out, the cleaning path is generally in front of the user, but when the wrists are rolled to either the right or to the left, the cleaning path traced by the nozzle ends follows the roll to the right and left of the wrist.

Generally, these devices perform quite well to pick up dirt and liquid spillage immediately subjacent to their nozzle ends, whether stationery, or when moved in one of the manners aforesaid. To clean areas that lie beyond the cleaning path obtained by manipulating such devices, various attachment tools need to be employed.

One type of known attachment tool is the crevice tool. Generally, such a tool includes an end for attachment to the nozzle end of a hand-held vacuum cleaner; a nozzle end, smaller than the nozzle end of the hand-held vacuum cleaner; and a rigid tube axially connecting the attachment and nozzle ends thereof in fluid-tight communication.

With the crevice tool attached, back and forth motion of the hand-held vacuum cleaner enables cleaning in small areas such as crevices of dirt and liquid spillage that lies along the cleaning path traced by the nozzle end of the hand-held vacuum cleaner. U.S. Pat. No. 4,951,340, incorporated herein by reference, discloses a multi-component crevice tool for a hand-held vacuum cleaner, the nozzle end of which may be indexed to different rotation positions so as to clean spillage in small areas defined by angular cross-sections, such as the small space between a bookshelf and a closely adjacent wall, that otherwise may not permit of ready cleaning (except, for example, by moving the bookcase away from the wall).

Another type of known attachment tool is the extension wand. Generally, such a tool includes an end for attachment to the nozzle end of a hand-held vacuum cleaner; a nozzle end; and an elongated, rigid tube connecting the attachment and nozzle ends thereof in fluid-tight communication. The reach of the hand-held vacuum cleaner is extended to the degree that the rigid interconnecting tube is elongated, thereby permitting cleaning of spillage in areas that otherwise would lie beyond the reach of the hand-held vacuum cleaner. U.S. Pat. No. 5,462,311, incorporated herein by reference, discloses a multi-component extension wand that telescopes so as to clean spillage in areas that may lie at different distances.

The heretofore known attachment tools, however, have had their utility limited either by requiring different tools for different purposes, which not only increased manufacturing cost and consumed time when it was necessary to change tools, but also necessitated providing storage space for each of the separate components, and gave rise to an increased possibility of loss or mis-placement of each of the different attachment tools; have been costly to manufacture due to their multi-component construction; and/or have not been entirely satisfactory in use.

SUMMARY OF THE INVENTION

Accordingly, it is a general object of the present invention to provide a novel attachment tool for a hand-held vacuum cleaner that overcomes the disadvantages of the heretofore known attachment tools.

It is a specific object of the present invention to provide a single, multi-purpose attachment tool operable in one mode as a crevice tool and in another mode as an extension wand, thereby overcoming the need to provide separate tools for different functions, therewith overcoming the need to provide storage space for multiple attachment tools, as well as reducing the possibility of loss or misplacement of the several, different attachment tools.

It is a related object of the present invention to provide a single, multi-purpose attachment tool of one-piece construction, that, while providing entirely satisfactory use in each of its different modes, is comparatively inexpensive to manufacture.

In accord with these and other objects, the multi-purpose attachment tool for a hand-held vacuum cleaner of the present invention includes an attachment end adapted for mounting to a hand-held vacuum cleaner, a nozzle end; and a self-supporting and selectably configurable accordion-joint integrally formed with and interconnecting said attachment and nozzle ends in fluid-tight communication. In one configuration in accord with the present invention, the accordion-joint is axially collapsed on itself to provide operation in a crevice tool mode. In another configuration, the accordion-joint is axially extended to provide operation in an elongated extension wand mode. In a third configuration in accord with the present invention, the self-supporting accordion-joint is both axially extended and bent off-axis to provide operation in crevice tool mode and/or extension wand modes. In each configuration, the attachment tool of the present invention retains its shape, whether axially collapsed, axially extended or extended and bent off-axis, and enables to clean spillage located in both small areas such as crevices and in regions spaced at different, variable distances, including otherwise hard-to-reach, off-axis locations.

BRIEF DESCRIPTION OF THE DRAWINGS

These and other features, advantageous aspects and inventive objects will become apparent as the invention becomes better understood by referring to the following, solely exemplary detailed description of the presently preferred embodiment, and to the drawings, wherein.

DETAILED DESCRIPTION OF THE PRESENTLY PREFERRED EMBODIMENT

Figure 1:
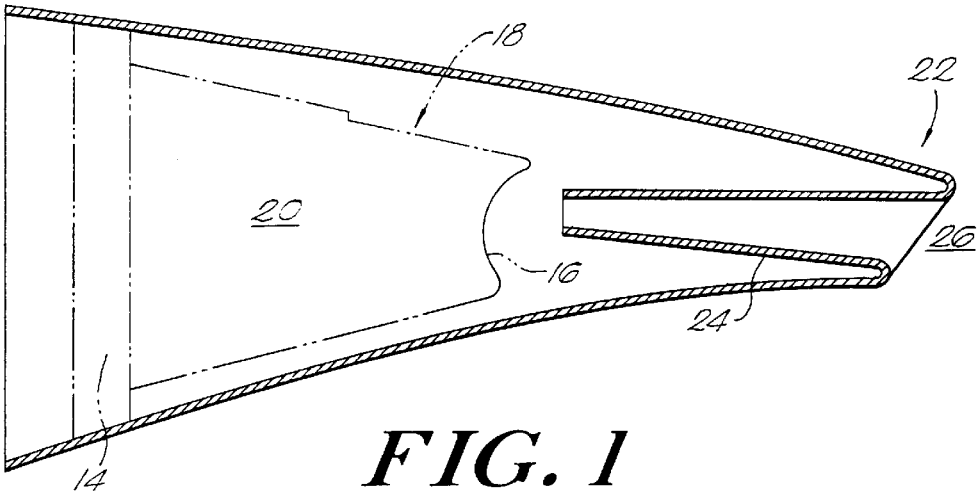
FIG. 1 is a longitudinal sectional view through the dust bowl of a hand-held vacuum cleaner, showing an optional wet-dry retention chamber and the nozzle end to which the novel multi-purpose attachment tool of the present invention is slidably mounted.

Referring now to FIG. 1, generally designated at 10 is a longitudinal sectional view of a dust bowl 12 of a hand-held vacuum cleaner. As will be readily appreciated by those of skill in the art, the dust bowl 12 is adapted for mounting to a vacuum cleaner power unit, not shown, which creates in well-known manner a vacuum condition drawing air and entrained dirt and liquid thereinthrough. An optional wet-dry retention chamber 14 shown in dashed outline may be inserted within dust bowl 12. The wet-dry retention chamber 14 includes a liquid deflector 16, and an opening generally designated 18 in communication with liquid storage region generally designated 20. The liquid deflector 16 prevents liquid from directly entering the power unit. The liquid storage region 20 retains condensed liquid, along with air and soil. The novel attachment tool of the present invention to be described could be used in any type of hand-held or other vacuum cleaner including one adapted for picking up dirt only, or one adapted for picking up dry and/or liquid spillage. A filter, not shown, is disposed between the wet-dry retention chamber 14 and the power unit to permit air to pass but to prevent the passage of soil. The power unit includes a plurality of battery cells, a handle and a switch positioned close to the handle to allow the user to control the application of power, and status indicating lights, all not shown. A charge and storage base, not shown, is provided to recharge the battery pack of the power unit and to stow one or more attachment tools.

Nozzle end generally designated 22 of dust bowl 12 includes an integrally formed suction tube 24. The suction tube 24 at one of its ends terminates in open mouth generally designated 26 of nozzle end 22, and, at the other of its ends, terminates in spaced-apart relation to liquid deflector 16 of wet-dry retention chamber 14. In the presently preferred embodiment, the suction tube 24 is provided with an elliptical cross-section, the major axis of which preferably is perpendicular to the long axis of suction tube 24.

Figure 2:
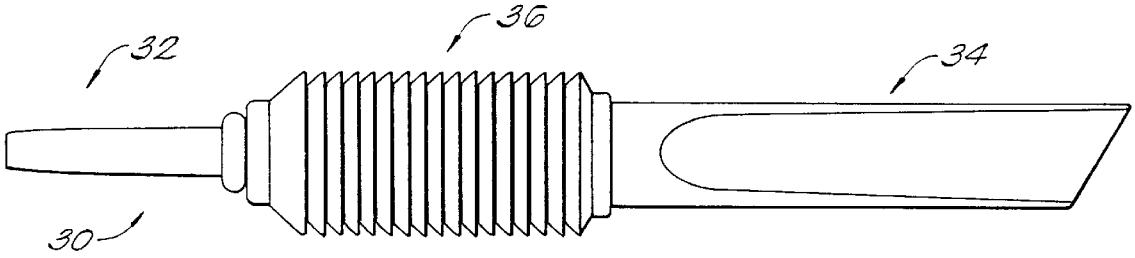
FIG. 2 is a side elevational view illustrating the multi-purpose attachment tool of the present invention configured for operation as a crevice tool.

Referring now to FIG. 2, generally designated at 30 is a side elevational view illustrating the multi-purpose attachment tool of the present invention configured for operation as a crevice tool. The attachment tool 30 includes an attachment end generally designated 32, a nozzle end generally designated 34, and a self-supporting expandable and bendable accordion-joint generally designated 36 integrally formed with and connecting the attachment end 32 and the nozzle end 34 in fluid-tight communication. In the presently preferred embodiment, the attachment tool 30 preferably is integrally formed of a plastic material by blow molding. As will be readily appreciated, the expandable accordion-joint 36 is illustrated in its collapsed configuration in FIG. 2, in which condition the attachment tool 30 of the present invention is operable as a crevice tool.

Figure 3:
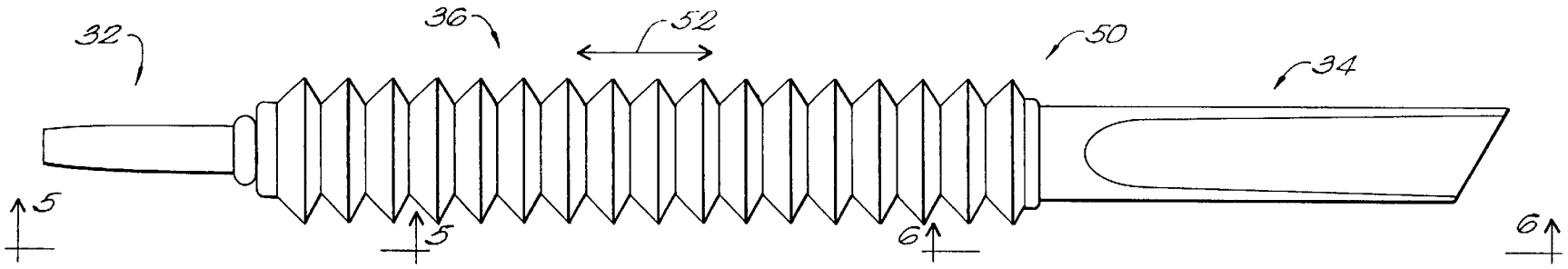
FIG. 3 is a side elevational view illustrating the attachment tool of the present invention configured for operation as an extension wand.
Figure 5:
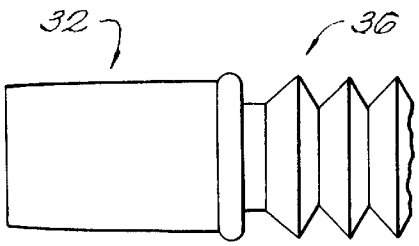
FIG. 5 is a plan view taken along the lines 5—5 of FIG. 3 illustrating the attachment end of the multi-purpose attachment tool of the present invention.

Attachment end 32 of the attachment tool 30 is adapted for friction-fit mounting in the suction tube 24 of the dust bowl 12. It preferably is wider than it is tall as best seen in FIGS. 3 and 5, and it preferably has an elliptical cross-section. Other attachment end configurations to permit ready insertion and removal, or other attachment means, may be employed to mount attachment tool 30 to nozzle end 22 of dust bowl 12.

Figure 6:
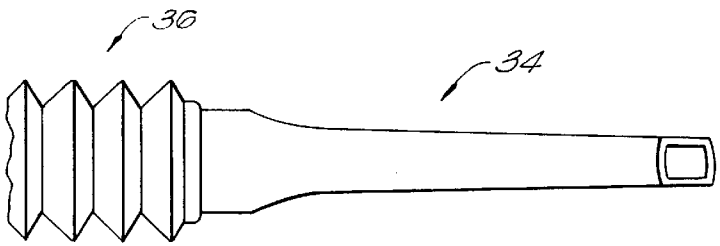
FIG. 6 is a plan view taken along the lines 6—6 of FIG. 3 illustrating the nozzle end of the multi-purpose attachment tool of the present invention.

Nozzle end 34 of the attachment tool 30 preferably has a rectangular cross-section, the longer axis of which preferably is at right angles to the long axis of the attachment tool 30, and is preferably angled at its free end, as best seen in FIGS. 3 and 6. As will readily be appreciated, the attachment end 32 of elliptical cross-section readily permits insertion of the attachment tool 30 right side up or upside down depending on the location of the area to be cleaned. Other nozzle end configurations may be employed.

Figure 2A:
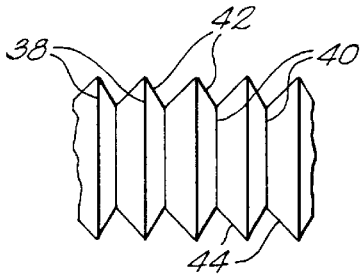
FIG. 2A is a side elevational view illustrating a part of the accordion-joint of the multi-purpose attachment tool of the present invention in expanded condition.

As illustrated in FIG. 2A, accordion-joint 36 preferably is an annular bellows consisting of a series of alternating, comparatively-large and comparatively-small annuli 36,38 interconnected by frusto-conical webs 42,44, whose wall thickness and web angles are selected such that the accordion-joint is self-supporting whether collapsed, expanded and/or bent. Other self-supporting accordion-joints, or other self-supporting joints that are expandable and bendable could be employed.

Referring now to FIG. 3, generally designated at 50 is a side elevational view illustrating the multi-purpose attachment tool of the present invention configured for operation as an extension wand. As illustrated, the attachment tool is in its fully axially extended condition, and it will be readily appreciated that it could be partially axially extended to clean spillage at areas located short of the maximum reach of the extension wand as schematically illustrated by arrow designated 52.

Figure 4:
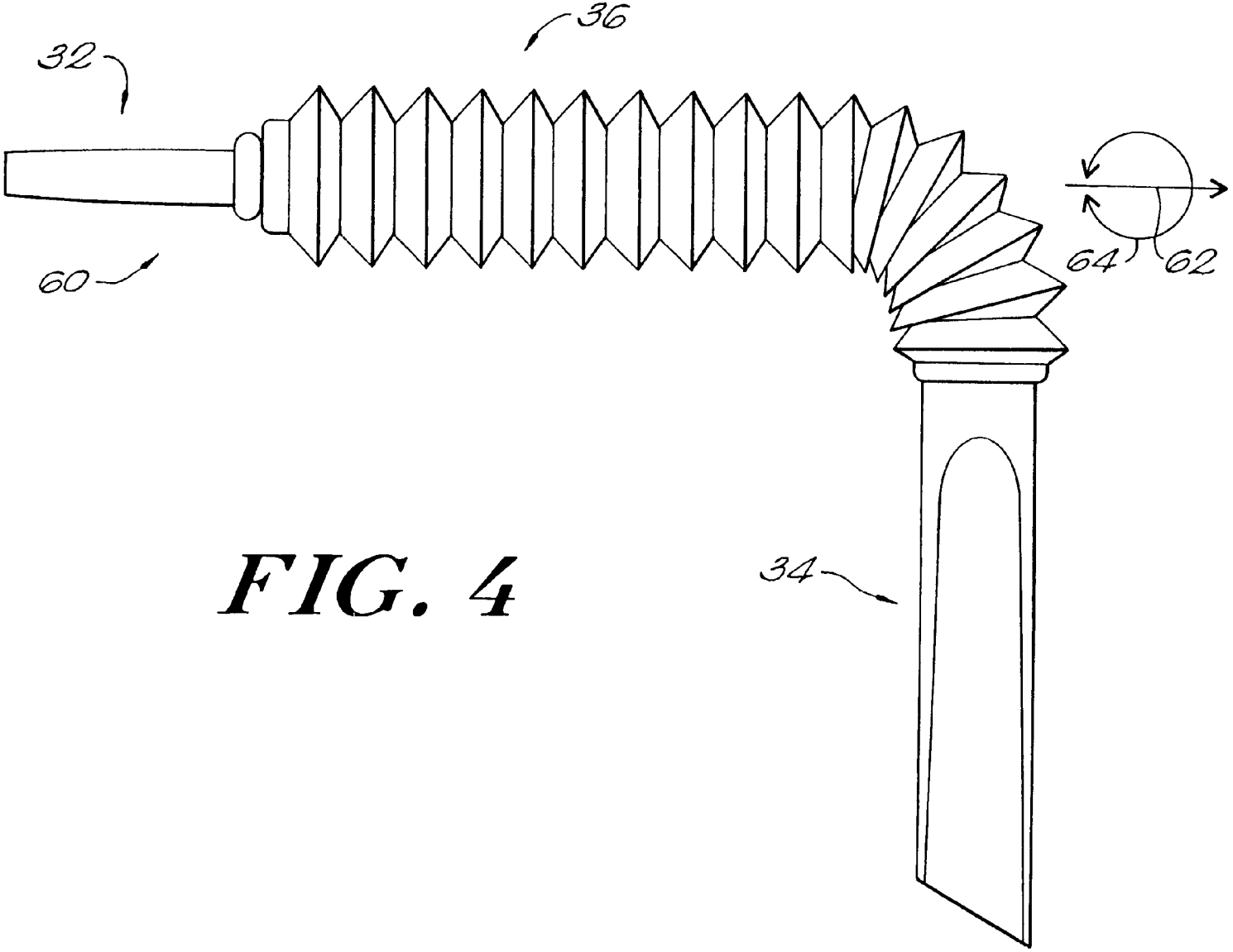
FIG. 4 also is a side elevational view that illustrates the multi-purpose attachment tool of the present invention configured for operation in a crevice tool mode and/or an extension wand mode, for cleaning spillage in hard-to-clean off-axis locations whether in small areas such as crevices or at distances otherwise inaccessible to the nozzle end of the hand-held vacuum cleaner.

Referring now to FIG. 4, generally designated at 60 is a side elevational view illustrating the multi-purpose attachment tool of the present invention configured for operation in extension wand and/or crevice tool modes. As illustrated, the attachment tool is in its fully axially extended condition and bent at ninety (90) degrees about a point near to the nozzle end 34 thereof. Of course, as will readily be appreciated, the attachment tool may be partially extended and bent to any desired angle at any point along its length, as schematically illustrated respectively by arrows designated 62,64, to reach otherwise hard-to-clean areas.

In each of its configurations, the multi-purpose attachment tool of the present invention either may be pre-bent and/or extended or collapsed and then inserted into the suction tube 24 of the nozzle end 22 of the dust bowl 12, or it may be configured in situ. In either case, the multi-purpose attachment tool of the present invention may be configured to provide effective cleaning in a wide variety of cleaning situations.

Many modifications of the presently disclosed invention will become apparent to those of skill in the art without departing from the inventive concepts.

What is claimed is:

1. A single, multi-purpose attachment tool for a hand-held vacuum cleaner operable in one mode as a crevice tool and in another mode as an extension wand, thereby overcoming the need to provide separate tools for different functions and therewith overcoming the need to provide storage space for multiple attachment tools and reducing the possibility of loss or misplacement of several, different attachment tools, comprising:

an attachment end adapted for mounting to a hand-held vacuum cleaner;

a nozzle end; and a self-supporting and selectably configurable accordion-joint integrally formed with and interconnecting said attachment and nozzle ends in fluid-tight communication;

in one configuration, the self-supporting accordion-joint is axially collapsed on itself to provide operation in a crevice tool mode;

in another configuration, the self-supporting accordion-joint is axially extended to provide operation in an elongated extension wand mode; and in a third configuration, the self-supporting accordion-joint is both axially extended and bent off-axis to provide operation in at least one of a crevice tool mode and an extension wand mode.

2. The multi-purpose attachment tool for a hand-held vacuum cleaner of claim 1, wherein, for each said configuration, the attachment tool retains its shape, whether axially collapsed, axially extended or extended and bent off-axis, and enables to clean spillage located in both small areas such as crevices and in regions spaced at different, variable distances, including otherwise hard-to-reach, off-axis locations.

3. The multi-purpose attachment tool of claim 1, wherein said attachment end, nozzle end and accordion-joint are of one-piece construction, that, while providing entirely satisfactory use in each of its different modes, is comparatively inexpensive to manufacture.

4. The multi-purpose attachment tool of claim 3, wherein said attachment end, nozzle end and accordion-joint of one-piece construction are integrally formed of a plastic material by blow molding.

5. The multi-purpose attachment tool of claim 1, wherein said accordion-joint is an annular bellows.

6. The multi-purpose attachment tool of claim 1, wherein said attachment end is adapted for friction-fit insertion into said hand-held vacuum cleaner.

7. A multi-purpose attachment tool for a vacuum cleaner operable in at least one of a crevice tool mode and an extension wand mode, comprising:

an attachment end adapted for mounting with said vacuum cleaner;

a nozzle end adapted for cleaning crevices; and a self-supporting joint that is both axially expandable and bendable off-axis coupling said attachment end and said nozzle end in fluid-tight communication;

whenever said self-supporting expandable joint is axially collapsed, said multi-purpose attachment tool is configured as a crevice tool;

whenever said self-supporting expandable joint is axially extended, said multi-purpose attachment tool is configured as an extension wand; and whenever said self-supporting expandable and bendable joint is both axially extended and bent off-axis, said multi-purpose attachment tool is configured in at least one of an extension wand mode and a crevice tool mode depending on the situation of the cleaning application.

8. The multi-purpose attachment tool for a vacuum cleaner of claim 7, wherein said self-supporting joint that is both expandable and bendable is an accordion-joint.

9. The multi-purpose attachment tool for a vacuum cleaner of claim 8, wherein said self-supporting accordion-joint is an annular bellows.

10. The multi-purpose attachment tool for a vacuum cleaner of claim 9, wherein said annular bellows is integral with said attachment and nozzle ends and formed of a plastic material by blow molding.

* * * * *